US012416422B2

(12) United States Patent
Kim et al.

(10) Patent No.: US 12,416,422 B2
(45) Date of Patent: Sep. 16, 2025

(54) HYGIENE MANAGEMENT DEVICE FOR ENTRANCE HALL AND CONTROL METHOD OF SAME

(71) Applicant: LG ELECTRONICS INC., Seoul (KR)

(72) Inventors: Taihong Kim, Seoul (KR); Hyunbyung Cha, Seoul (KR); Hyunsun Yoo, Seoul (KR); Joohyeon Oh, Seoul (KR); Byoungjoonphilip Han, Seoul (KR); Sang Yoon Lee, Seoul (KR); HyunJu Kim, Seoul (KR); Chul Bae Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 602 days.

(21) Appl. No.: 17/550,961

(22) Filed: Dec. 14, 2021

(65) Prior Publication Data

US 2022/0186959 A1 Jun. 16, 2022

(30) Foreign Application Priority Data

Dec. 14, 2020 (KR) ..... 10-2020-0174512
Feb. 4, 2021 (KR) ..... 10-2021-0015906

(51) Int. Cl.
*F24F 9/00* (2006.01)
*F24F 11/79* (2018.01)
(Continued)

(52) U.S. Cl.
CPC ..... *F24F 9/00* (2013.01); *F24F 11/79* (2018.01); *F24F 13/072* (2013.01); *F24F 2009/007* (2013.01); *F24F 2120/12* (2018.01)

(58) Field of Classification Search
CPC .. F24F 9/00; F24F 11/79; F24F 13/072; F24F 2009/007; F24F 2120/12
See application file for complete search history.

(56) References Cited

U.S. PATENT DOCUMENTS 3,068,775 A 12/1962 Zehnder
3,097,587 A * 7/1963 Kurek ..... F24F 7/10 454/192

(Continued)

FOREIGN PATENT DOCUMENTS

CN 2829925 Y 10/2006
CN 2849545 Y 12/2006

(Continued)

OTHER PUBLICATIONS

Xu et al., "Mechanical Industry Heating Ventilation and Air Conditioning Design Manual," Tongji University Press, Edition 1, Mar. 2007, 12 pages total, with English translation.

*Primary Examiner* — Edelmira Bosques
*Assistant Examiner* — Michael James Giordano
(74) *Attorney, Agent, or Firm* — Birch, Stewart, Kolasch & Birch, LLP

(57) ABSTRACT

A hygiene management device for an entrance hall and a control method of the same are proposed. The hygiene management device may be installed in the space of the entrance hall, and when the opening of an entrance door is detected, air is discharged toward the entrance door by tilting an air discharger toward the entrance door, and when the closing of the entrance door is detected, the air discharger is tilted to a preset initial position to stop the discharging of air. Accordingly, during the opening of the entrance door, the introduction of external air into the space of the entrance hall may be minimized.

16 Claims, 18 Drawing Sheets

(51) Int. Cl.
*F24F 13/072* (2006.01)
*F24F 120/12* (2018.01)

(56) References Cited

U.S. PATENT DOCUMENTS

| | | | | | |
|---|---|---|---|---|---|
| 5,746,652 | A | * | 5/1998 | Lee | B08B 5/02 454/187 |
| 6,015,342 | A | * | 1/2000 | Dennis | F24F 1/0011 454/316 |
| 10,532,119 | B2 | | 1/2020 | Dombrowsky et al. | |
| 11,083,815 | B1 | | 8/2021 | Lee | |
| 2018/0369434 | A1 | | 12/2018 | Callahan | |
| 2019/0321503 | A1 | | 10/2019 | Warnell | |

FOREIGN PATENT DOCUMENTS

| | | | | | |
|---|---|---|---|---|---|
| CN | 103196201 | A | | 7/2013 | |
| CN | 103599900 | A | * | 2/2014 | B08B 5/02 |
| CN | 204503669 | U | * | 7/2015 | |
| CN | 207285658 | U | | 5/2018 | |
| CN | 108655109 | A | | 10/2018 | |
| DE | 102004001765 | A1 | * | 8/2005 | F24F 9/00 |
| EP | 2455679 | A1 | * | 5/2012 | F24F 1/0011 |
| GB | 1527907 | A | * | 10/1978 | F24F 13/02 |
| JP | 4109771 | B2 | | 7/2008 | |
| JP | 4824885 | B2 | | 11/2011 | |
| JP | 2020-139670 | A | | 9/2020 | |
| KR | 10-2009-0040630 | A | | 4/2009 | |
| KR | 10-1030583 | B1 | | 4/2011 | |
| KR | 10-2019-0055303 | A | | 5/2019 | |
| KR | 10-2020-0046715 | A | | 5/2020 | |
| KR | 102151990 | B1 | * | 9/2020 | |
| KR | 10-2020-0112031 | A | | 10/2020 | |
| KR | 10-2020-0117286 | A | | 10/2020 | |
| KR | 20200112031 | A | * | 10/2020 | |

* cited by examiner

HYGIENE MANAGEMENT DEVICE FOR ENTRANCE HALL AND CONTROL METHOD OF SAME

CROSS REFERENCE TO RELATED APPLICATIONS

The present application claims the priority benefit of Korean Patent Application No. 10-2020-0174512 filed on Dec. 14, 2020 in the Republic of Korea and 10-2021-0015906 filed on Feb. 4, 2021, in the Republic of Korea, which are hereby incorporated by reference in their entirety for all purposes as if fully set forth herein.

BACKGROUND OF THE INVENTION

1. Field of the Invention

The present disclosure relates to a hygiene management device for an entrance hall and a control method of the same.

2. Description of the Background Art

Generally, in order to enter an indoor space from the outside, a visitor is required to go through an entrance hall which separates the outside from the indoor space. For example, in the case of a house, a vestibule as an entrance hall is provided, and thus to enter the house, a person is required to go through the vestibule.

Recently, air quality outside is getting worse due to yellow dust or fine dust. In this situation, when yellow dust or fine dust enters an indoor space from the outside, the indoor space may be contaminated.

In a dense environment (i.e., a small indoor space), such as an apartment, removing contaminants outside an entrance door may cause the contaminants to be transferred to surrounding people. Accordingly, before a visitor enters an indoor space, it is necessary to remove contaminants attached to the visitor in an entrance hall such as a vestibule.

Technologies for preventing contaminants from being transferred to the indoor space are disclosed.

An air shower for a vestibule of a house is disclosed in (Patent Document 1) Korean Patent Application Publication No. 10-2009-0040630. In the related art disclosed in (Patent Document 1), air is showered on a visitor to remove contaminants, such as dust, on the clothing of the visitor.

However, the air applied to the visitor flows downward from the upper portion, so the air is applied mainly to the visitor's head and to the upper portion of the visitor's upper body and thus contaminants on the visitor's lower body and shoes are not properly removed. Furthermore, in the vestibule, an air introduction hole into, which air is introduced, is located at the side surface of a vestibule space, so contaminants such as dust remain on the bottom of the vestibule.

An air shower system for a vestibule is disclosed in (Patent Document 2) Korean Patent Application Publication No. 10-2020-0117286. In the air shower system disclosed in (Patent Document 2), in addition to the air shower, a photocatalytic lamp is installed on a ceiling to simultaneously remove contaminants, such as dust, and harmful substances, such as viruses, on the clothing of a visitor.

However, even the related art disclosed in (Patent Document 2), has the problems that contaminants, such as dust, remain on the bottom of a vestibule, and contaminants on a visitor's lower body and shoes are not properly removed due to the emission of light by the photocatalytic lamp from the ceiling.

A lighting-integrated air cleaning system for entrance space and a control method of the same are disclosed in (Patent Document 3) Korean Patent Application Publication No. 10-2020-0046715. In the related art disclosed in (Patent Document 3), a lighting fixture and an air cleaning system are integrated with each other such that contaminants are removed from a visitor in an entrance space such as a vestibule.

However, even in the related art disclosed in (Patent Document 3), a structure in which air is simply discharged downward from the upper side is integrated with the light fixture, and an air introduction hole is formed in the side surface of the entrance space, so contaminants in the entrance space are not properly removed.

An air shower apparatus integrated with a vestibule door is disclosed in (Patent Document 4) Korean Patent Application Publication No. 10-2019-0055303. In the related art disclosed in (Patent Document 4), a shower booth having a shower space thereinside is separately installed, such that a visitor can remove contaminants in the shower booth.

However, the shower booth disclosed in (Patent Document 4) is separately partitioned in space inside a vestibule, and thus a space occupied by an entire device inside the vestibule increases, so the air shower apparatus is not effective. Furthermore, the air shower apparatus has a simple structure in which air is discharged downward from an upper side, so ability with which the air shower apparatus removes contaminants decreases.

In addition in the related arts disclosed in Patent Documents 1 to 4 described above, in a process in which a visitor opens and closes an entrance door, outdoor contaminants are introduced through the entrance door into a vestibule and the internal space of the vestibule is contaminated.

Documents of Related Art (Patent Document 1) Korean Patent Application Publication No. 10-2009-0040630
(Patent Document 2) Korean Patent Application Publication No. 10-2020-0117286
(Patent Document 3) Korean Patent Application Publication No. 10-2020-0046715
(Patent Document 4) Korean Patent Application Publication No. 10-2019-0055303

SUMMARY OF THE INVENTION

Accordingly, the present disclosure has been made keeping in mind the above problems occurring in the related art, and the present disclosure is intended to propose a hygiene management device for an entrance hall and the control method of the same in which air is discharged to a user, such that contaminants attached to the user's body and clothes are removed.

The present disclosure is intended to propose a hygiene management device for an entrance hall and the control method of the same involving a process in which a user opens and closes an entrance door to go in and out of an indoor area, external contaminants are prevented from being introduced into the entrance hall.

The present disclosure is intended to propose a hygiene management device for an entrance hall and the control method of the same in which after contaminated air in the entrance hall is introduced into a footrest to be purified, the purified air is discharged back into the entrance hall.

The present disclosure is intended to propose a hygiene management device for an entrance hall and the control method of the same in which a user going into the entrance hall is detected and air is automatically discharged to the user.

The present disclosure is intended to propose a hygiene management device for an entrance hall and the control method of the same in which when a user is located at a preset specific position within the hygiene management device, the user is detected and air is automatically discharged to the user.

The present disclosure is intended to propose a hygiene management device for an entrance hall and the control method of the same in which the discharge direction of air may be changed according to the opening and closing of the entrance door.

The present disclosure is intended to propose a hygiene management device for an entrance hall and the control method of the same in which the discharge direction of air is changed according to a position to which a user moves.

According to the hygiene management device for an entrance hall of the present disclosure and the control method of the same, an air discharger for discharging air inside a specific space may be provided.

According to the hygiene management device for an entrance hall of the present disclosure and the control method of the same, the air discharger may discharge air to a user located inside a specific space, such that contaminants on the user's clothing or shoes can be removed.

According to the hygiene management device for an entrance hall of the present disclosure and the control method of the same, when a user stands on a footrest, the user may be detected and the air discharger may discharge air toward the user.

According to the hygiene management device for an entrance hall of the present disclosure and the control method of the same, when an entrance door is opened, the air discharger may be tilted toward the entrance door to discharge air. Accordingly, external air may be prevented from being introduced through the opened entrance door into the entrance hall from the outside.

The hygiene management device for an entrance hall of the present disclosure may include: a first detector configured to detect the opening/closing of the entrance door installed in the entrance hall, an air discharger mounted to the upper portion of the entrance hall and configured to discharge air, a fan assembly configured to supply a blowing force such that air is discharged by the air discharger, a lift assembly configured to tilt the air discharger, and a controller configured to drive the fan assembly and the lift assembly, wherein when the first detector detects the opening of the entrance door, the controller may drive the lift assembly to tilt the air discharger and may drive the fan assembly such that the tilted air discharger discharges air.

The hygiene management device for an entrance hall of the present disclosure may further include a second detector configured to detect whether a user is present on a footrest of the hygiene management device, wherein when the user is detected by the second detector, the controller may drive the fan assembly such that the air discharger discharges air toward the user.

According to the hygiene management device for an entrance hall of the present disclosure and the control method of the same, the lift assembly may tilt the air discharger such that the direction of air discharged by the air discharger is directed toward an entrance door.

According to the hygiene management device for an entrance hall of the present disclosure and the control method of the same, when the entrance door is opened, the lift assembly may be driven such that the air discharger is tilted toward the entrance door, and air may be discharged toward the entrance door, and later when the entrance door is closed, the lift assembly may be driven to tilt the air discharger to a preset initial position and the air discharge may stop.

According to the hygiene management device for an entrance hall of the present disclosure and the control method of the same, when tilting the air discharger to an initial position, the direction of air discharged by the air discharger may be directed toward a center of the space of the entrance hall.

According to the hygiene management device for an entrance hall of the present disclosure and the control method of the same, when a user stands on the footrest, the fan assembly may operate such that the internal air of an entrance space is introduced into the footrest through multiple introduction holes formed in the footrest.

According to the hygiene management device for an entrance hall of the present disclosure and the control method of the same, air introduced into the footrest may pass through one or multiple filters and a duct, and may be discharged back into the entrance space through the air discharger.

According to the hygiene management device for an entrance hall of the present disclosure and the control method of the same, when a preset period of time elapses after air is discharged toward a user on the footrest, the air discharger may stop air discharge.

According to the hygiene management device for an entrance hall of the present disclosure and the control method of the same, even before the preset period of time elapses, when a user is not detected on the footrest, the air discharger may stop air discharge.

According to the hygiene management device for an entrance hall of the present disclosure, the lift assembly may include first and second lifts installed on the opposite edges of the air discharger, respectively, and lift motors configured to drive the first and second lifts, respectively. When tilting the air discharger, one of the first lift and the second lift may operate to tilt the air discharger such that an edge of a side of the air discharger is lowered.

According to the hygiene management device for an entrance hall of the present disclosure, multiple vanes may be disposed at predetermined intervals in the air discharger so as to preset the direction of air discharged by the air discharger (i.e., air discharged by the air discharger follows an air flow path defined by the multiple vanes), wherein each of the vanes may have height increasing gradually toward the flow direction of air.

The control method of a hygiene management device for an entrance hall of the present disclosure may include: detecting whether the entrance door mounted to the entrance hall is opened, tilting the air discharger toward the entrance door when the opening is detected, and discharging air by the air discharger.

The control method of a hygiene management device for an entrance hall of the present disclosure may further include stopping the discharging of air by the air discharger such that after the discharging of air, whether the entrance door is closed is detected and when the closing of the entrance door is detected, the air discharger is tilted to a preset initial position.

The hygiene management device for an entrance hall according to the present disclosure and the control method of the same may have at least one of the following effects.

According to the present disclosure, air may be discharged to a user, thereby removing contaminants attached to a user's body and clothes.

According to the present disclosure, in the entrance space blocked from an indoor area, air may be discharged toward a user, thereby preventing external contaminants from being introduced into the indoor area.

According to the present disclosure, in a process in which a user opens and closes the entrance door to go in and out of the indoor area, external contaminants may be prevented from being introduced into the entrance hall.

According to the present disclosure, air in the space of the entrance hall may be introduced into the footrest and be purified, and the purified air may be discharged back into the space of the entrance hall, thereby managing the inside of the space of the entrance hall to be pleasant.

According to the present disclosure, when a user stands on the footrest which is designated, air may be automatically discharged toward a user, thereby providing convenience.

According to the present disclosure, the discharge direction of air may be changed according to the opening and closing of the entrance door, thereby preventing the introduction of external air into the entrance space and removing the internal contaminants of the entrance space in correspondence to the opening and closing of the entrance door.

BRIEF DESCRIPTION OF THE DRAWINGS

The above and other objectives, features, and other advantages of the present disclosure will be more clearly understood from the following detailed description when taken in conjunction with the accompanying drawings, in which.

DETAILED DESCRIPTION OF THE PREFERRED EMBODIMENTS

Figure 1:
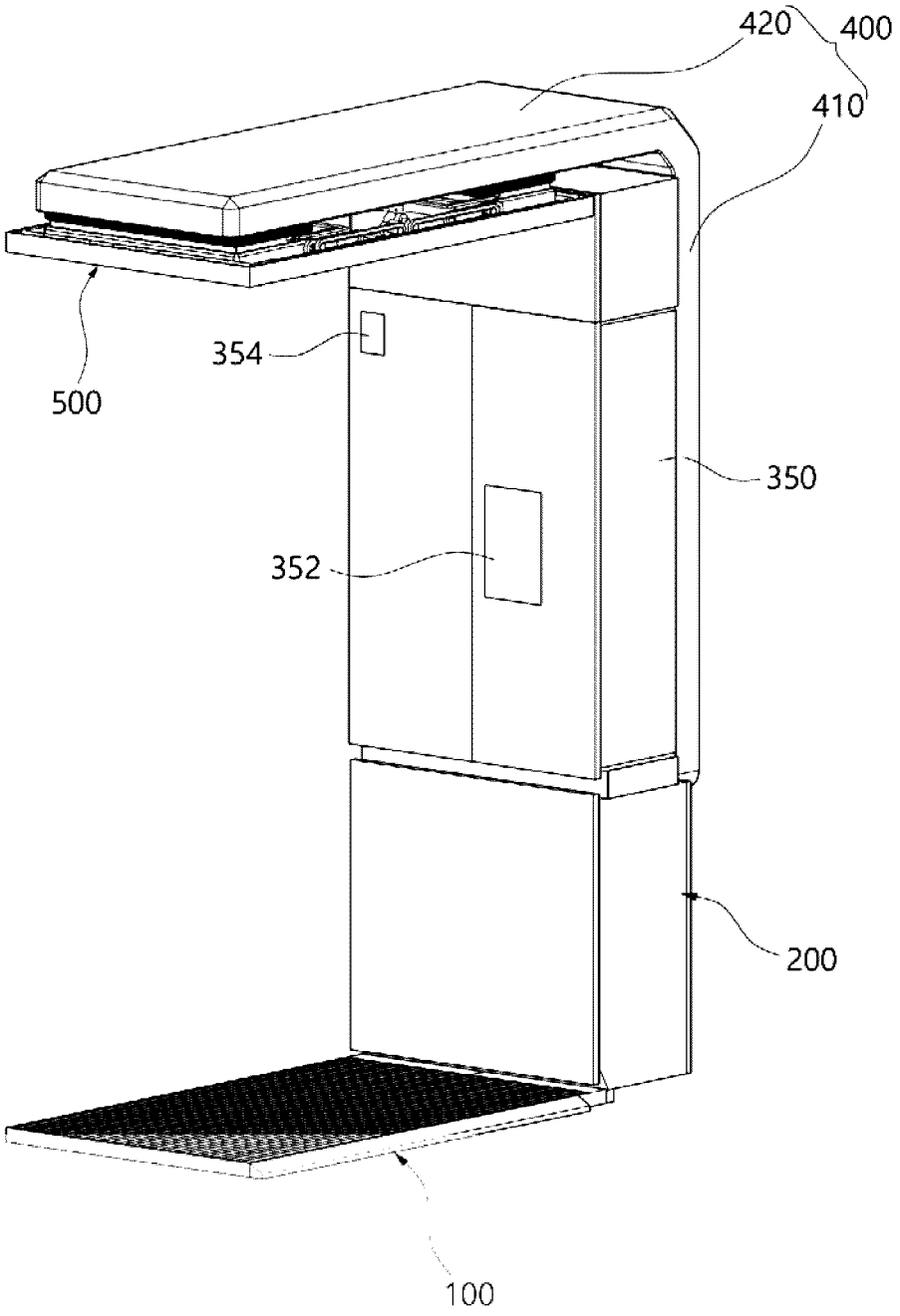
FIG. 1 is a perspective view unidirectionally illustrating the configuration of a hygiene management device for an entrance hall according to an embodiment of the present invention.
Figure 2:
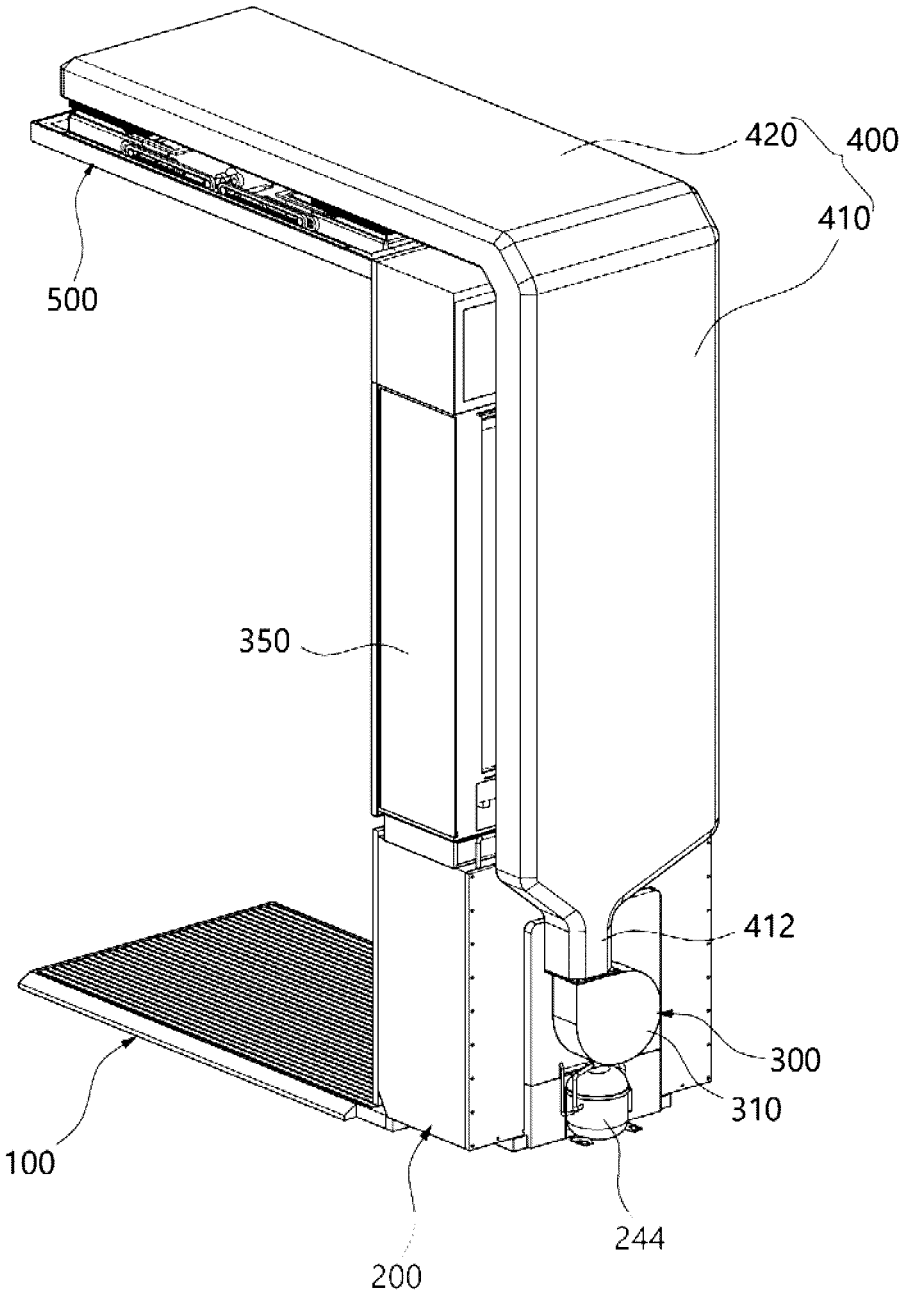
FIG. 2 is a rear perspective view illustrating the configuration of the hygiene management device according to an embodiment of the present invention.

The exemplary embodiment of a hygiene management device for an entrance hall of the present disclosure and the control method of the same will be described in detail with reference to the accompanying drawings.

The hygiene management device 1000 according to the embodiment of the present disclosure may be installed inside the space 12 (e.g., entrance space 12) of the entrance hall 10 for access to a specific indoor space. When the hygiene management device is installed in a residential space 12, the hygiene management device may be installed in a vestibule. When the hygiene management device is installed in an office space 12, the hygiene management device may be installed in space which is separately partitioned in the entrance hall of the associated office space.

An entrance door 14 for going out to or coming in from the outside may be provided at a first side surface of the entrance hall 10, and an inside door 16 for entering and exiting the indoor space may be provided at a second side surface of the entrance hall 10 opposite to the first side surface of the entrance hall 10.

A footrest 100 may be installed on the bottom of the entrance hall 10 having space 12 defined therein. The footrest 100 may have a predetermined area (i.e., a predetermined size and shape) such that a visitor can stand on the footrest 100 and may function to support the visitor.

As illustrated in the drawing, the footrest 100 may be configured as a rectangular plate shape having space defined therein. However, according to the shape of the entrance space 12, the shape of the footrest 100 may be configured to have various plate shapes or any type of shape.

A plurality of introduction holes may be formed in the upper surface of the footrest 100 such that air in the space 12 of the entrance hall 10 is introduced into the footrest 100, and due to the operation of a fan assembly 300, which is described below, the air in the space 12 of the entrance hall 10 may be introduced into the footrest 100.

The air introduced into the internal space of the footrest 100 through such introduction holes may be transferred through a predetermined flow path to an air management module 200. The air management module 200 may remove foreign matter contained in the air transferred thereto through the predetermined flow path and may function to manage the humidity and temperature of the air.

The air management module 200 may include a plurality of filters 221, 223, and 225. These filters 221, 223, and 225 may be disposed in an air flow path formed in the air management module such that air supplied to the air management module 200 passes through the filters 221, 223, and 225.

Each of the filters 221, 223, and 225 may have a specific function. For example, a first filter 221 may have the function of removing moisture. A second filter 223 may have the function of removing contaminants and dust (e.g., fine dust). A third filter 225 may have an antibacterial function. Alternatively, filters having other functions may be included in the air management module 200.

In order to preset the temperature of air passing through the air management module 200, a heat exchanger 240 may be installed. The heat exchanger 240 may exchange heat with air passing through the filters 221, 223, and 225. The heat exchanger 240 may be installed in a heat exchanger casing 242.

Air may flow through the heat exchanger casing 242 in a front-to-rear direction, with the front direction facing towards the footrest 100 and the rear direction facing away from the footrest 100. The outlet of the heat exchanger casing 242 may communicate with the fan assembly 300 to be described below. There may be components of a heat exchange cycle for heat exchange. Reference numeral 244 denotes a compressor.

The fan assembly 300 may be mounted to the rear surface of the air management module 200, that is, the outlet of the air management module 200 through which air flows out. The fan assembly 300 may supply an air blowing force such that air flows in the hygiene management device 1000. Due to such an air blowing force, an air discharger 500 to be described below may discharge air to the outside.

A fan housing 310 may constitute the exterior of the fan assembly 300. A housing internal space 314 may be defined in the fan housing 310, and the housing internal space 314 may be configured such that air introduced to the fan housing 310 from a position in front of the fan housing 310 is discharged from the fan housing 310 through an outer surface thereof.

A fan 316 may be installed in the fan housing 310. The fan 316 may be driven by a fan motor to allow air to be introduced to the fan housing 310 through an inlet of the fan housing 310 and to allow the air to be discharged through the outlet of the fan housing 310.

A function module 350 may be installed on a position corresponding to the upper side of the air management module 200 (i.e., positioned above the air management module 200). There may be a clothing management device as an example of the function module 350. When clothes are placed inside the clothing management device, the clothing management device can remove dust from the clothes or sterilize the clothes. In addition, the clothing management device may function to unwrinkle clothing, such as by steaming. Further, any type of item may be inserted into the function module 350, such as shoes, glasses, an umbrella or the like.

As other examples of the function module 350, there may be various devices such as a shoe management device, an umbrella management device, a shoe storage device, and an umbrella storage device. For reference, each of these function modules 350 may not be configured as an independent function module, but some of the function modules may be combined with each other.

A control panel 352 may be mounted to the front surface part of the function module 350 (i.e., a surface disposed between the footrest 100 and the air discharger 500) so as to preset and control various operations and functions of the hygiene management device 1000 of the present disclosure. Such a control panel 352 may preset and control the various operations and functions of the function module 350.

The control panel 352 may be a device in which an input device and a display device (a display, such as a touch screen, and OLED screen and the like) are integrated with each other. The input device may be embodied as a touch pad or a touch screen.

A duct 400 may function to move an air flow generated in the fan assembly 300 to the relatively upper portion of the entrance hall 10. The duct 400 may include a first duct 410 and a second duct 420.

The first duct 410 may extend along the side wall of the entrance hall 10, may extend vertically and may define an outer side surface of the hygiene management device 1000. A first inlet 412 of the first duct 410 may be connected to the outlet of the fan housing 310 of the fan assembly 300, and thus air may be transferred through the outlet of the fan housing 310 to the first inlet 412 of the first duct 410.

The first duct 410 may have a branch flow path through which air can be supplied to the function module 350. There may be a separate damper inside each of the branch flow path and the first duct 410 to control the flow of air therein.

The second duct 420 may be located on the upper portion of the entrance hall 10. The second duct 420 may allow air passing through the first duct 410 to flow therein such that the air can be supplied to the air discharger 500 to be described below. The second duct 420 may have a first outlet 422 and a second outlet 424.

Figure 3:
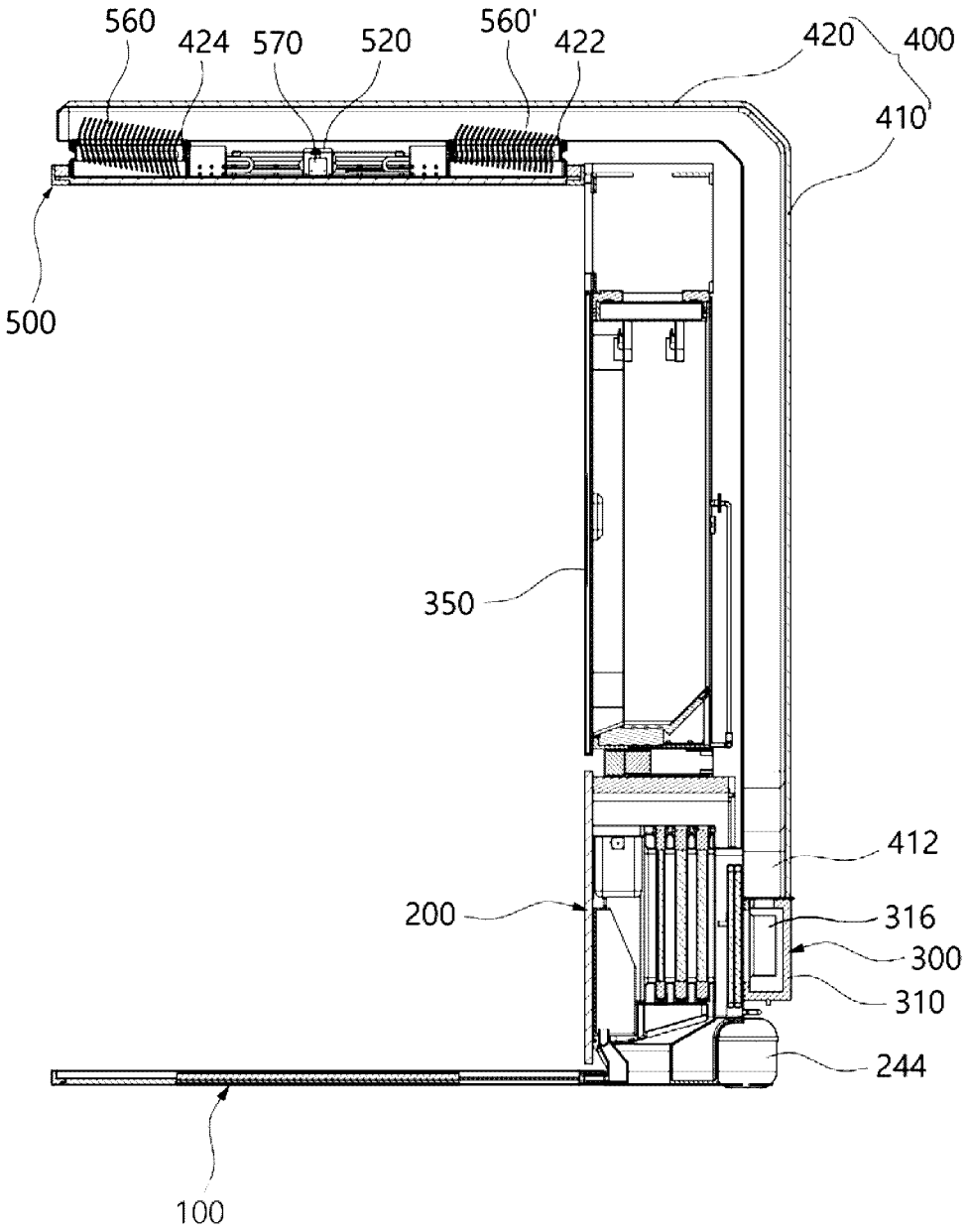
FIG. 3 is a sectional view illustrating the configuration of the hygiene management device according to an embodiment of the present invention.
Figure 4:
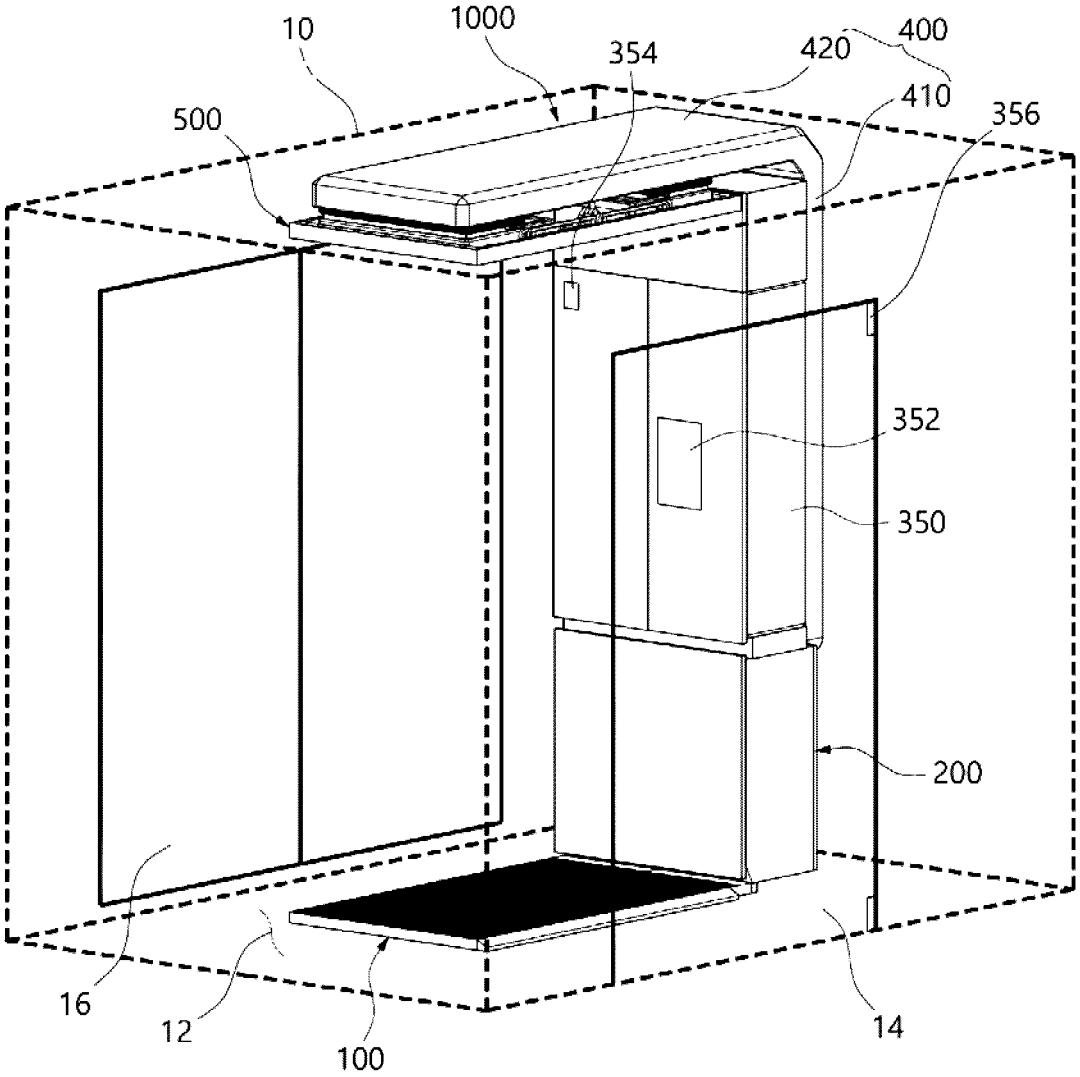
FIG. 4 is a view illustrating the hygiene management device disposed in an entrance space according to an embodiment of the present invention.
Figure 5:
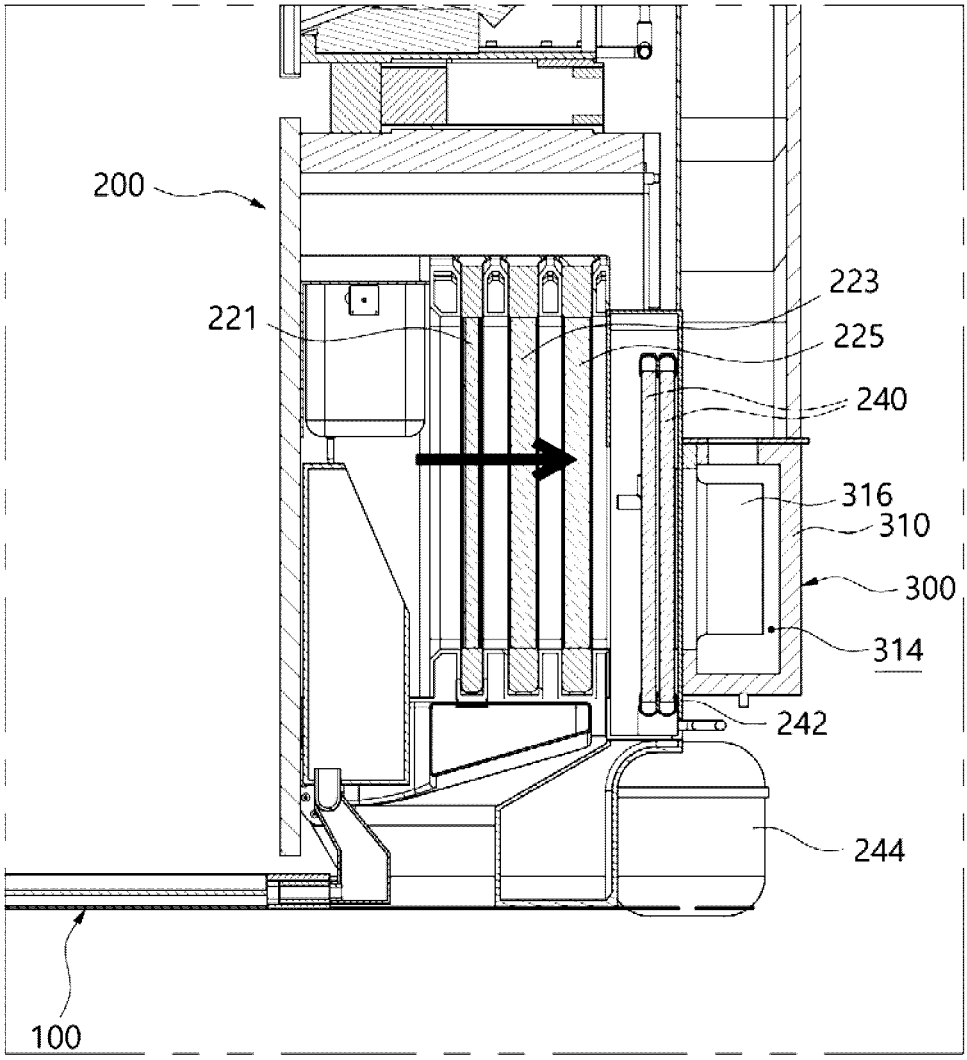
FIG. 5 is a sectional view illustrating the internal configuration of an air management module according an embodiment of the present invention.
Figure 6:
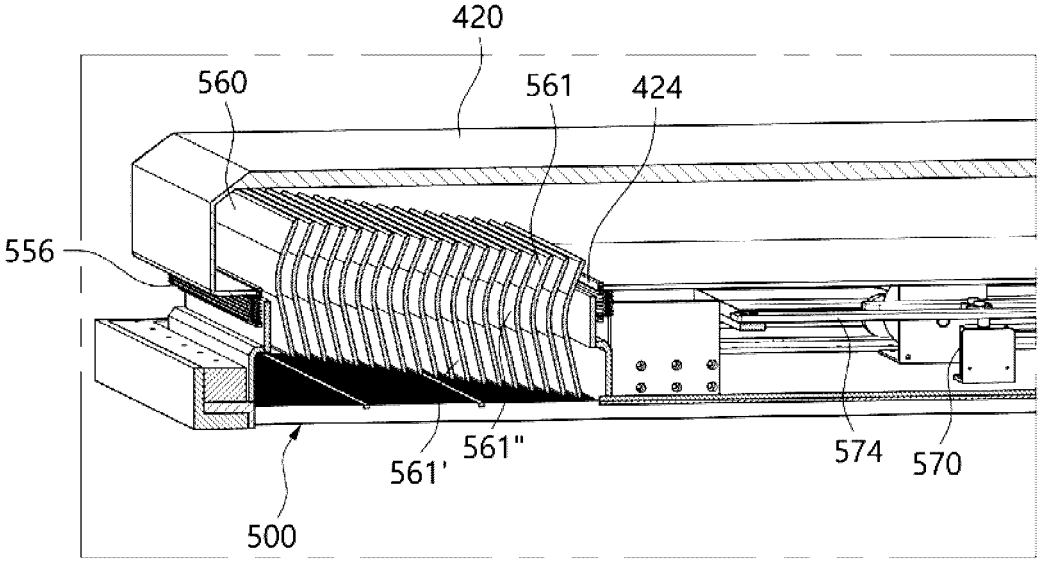
FIG. 6 is a sectional perspective view illustrating the configuration of each of an air discharger and a second outlet of a duct according to an embodiment of the present invention.
Figure 7:
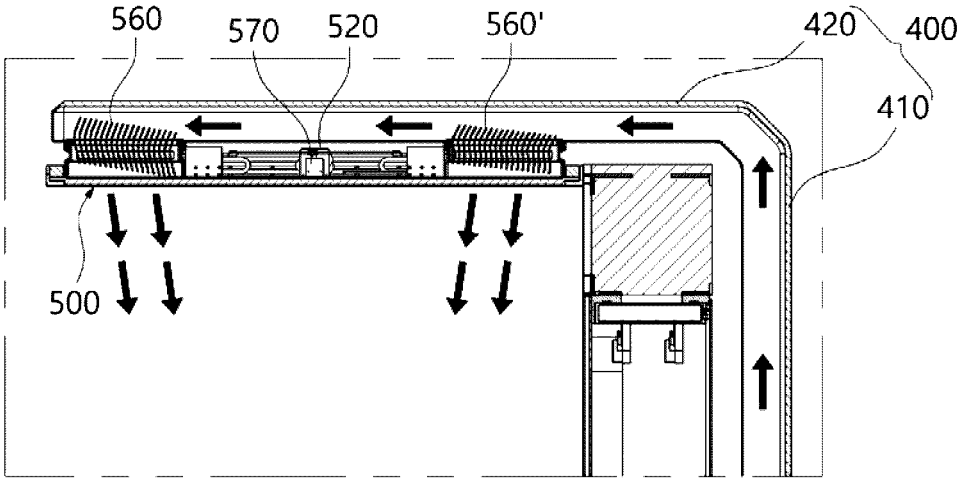
FIG. 7 is a sectional view illustrating the configuration of each of portions of the air discharger and the duct in which vanes are installed and the flow of air according to an embodiment of the present invention.

The first outlet 422 may be located in a relatively upstream portion of the second duct 420 relative to the flowing direction of air inside the second duct 420, and the second outlet 424 may be located in a relatively downstream portion of the second duct 420 compared to the first outlet 422. As illustrated in FIG. 3, the first outlet 422 may be located closer to the first duct 410 than the second outlet 424.

The air discharger 500 may be connected to the second duct 420 of the upper portion of the entrance hall 10. The air discharger 500 may discharge air transferred through the duct 400 into the space 12 of the entrance hall 10.

The air discharger 500 may discharge air transferred through each of the first outlet 422 and the second outlet 424 of the second duct 420 into the space 12. The air discharger 500 may preset and change the amount (i.e., volume), speed, and direction of the transferred air.

Discharge holes through which air is discharged may be formed in the air discharger 500. In the embodiment, the discharge holes may be formed in positions, respectively, corresponding to the first outlet 422 and the second outlet 424 of the second duct 420. The discharge holes may be open to the lower surface of the air discharger 500.

A corrugated pipe 556 may be installed on a portion on which the second duct 420 and the air discharger 500 are connected to each other to prevent air from leaking even when the air discharger 500 moves.

The corrugated pipe 556 may be flexible, and thus although the air discharger 500 moves relative to the duct 400, a connection state between the second duct 420 and the air discharger 500 may be maintained. The corrugated pipe 556 may connect the second duct 420 with the air discharger 500 in each of the first outlet 422 and the second outlet 424 of the second duct 420. That is, the corrugated pipe 556 may be provided in plurality.

The air discharger 500 may be provided with a lift assembly 520. The lift assembly 520 may include a first lift 521 and a second lift 521'. The lift assembly 520 may be driven by a controller 900, which is described below.

The first and second lifts 521 and 521' are intended to tilt the air discharger 500 by moving up and down the opposite edges of the air discharger 500.

The first lift 521 and the second lift 521' may be installed on the opposite edges of the air discharger 500, respectively, and a specific portion of the air discharger 500 may be moved down by these lifts 521 and 521' so as to tilt the air discharger 500.

Figure 9A:
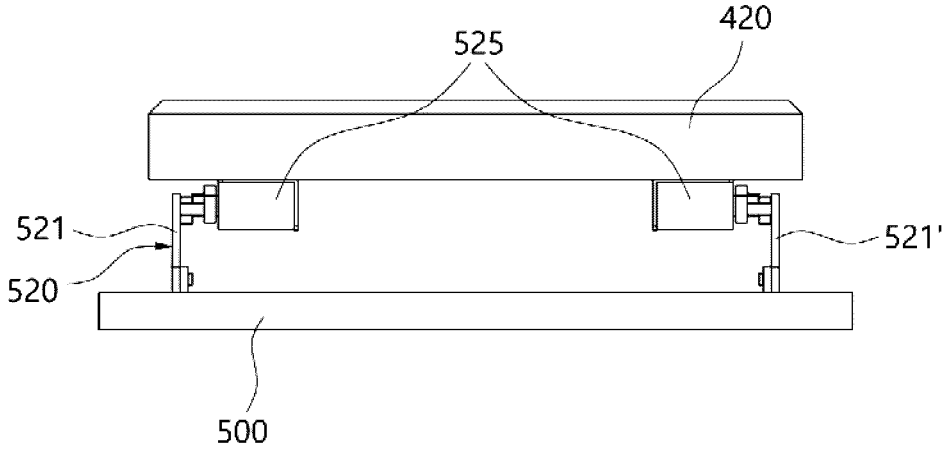
FIGS. 9A and 9B are views illustrating first and second lifts in the air discharger according to an embodiment of the present invention.
Figure 9B:
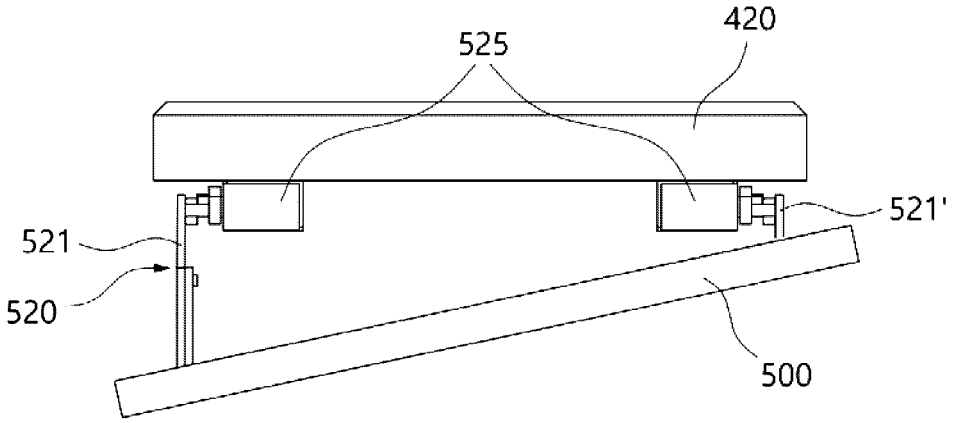

Accordingly, a direction (e.g., an angle) to which the lower surface of the air discharger 500 is directed may be adjusted to adjust the discharge direction of air. A driving force for operating the first and second lifts 521 and 521' may be supplied by at least one lift motor 525. Specifically, there may be two lift motors 525, as shown in FIGS. 9A and 9B, and each lift motor 525 may be for applying the driving force for a respective one of the first and second lifts 521 and 521'.

A portion of each of parts of the first and second lifts 521 and 521' may be mounted to the second duct 420 or the upper portion of the entrance space 12, and the remaining portion thereof may be mounted to the air discharger 500. That is, a first portion or a first end of each of parts of the first and second lifts 521 and 521' may be mounted to the second duct 420 or the upper portion of the entrance space 12, and a second portion or a second end thereof may be mounted to the air discharger 500. Due to a specific part of the air discharger 500 moved up and down by the lifts 521 and 521', a direction to which the lower surface of the air discharger 500 is directed may be adjusted.

The first and second lifts 521 and 521' may be replaced by other components which perform the same functions, as known in the art. In the hygiene management device of the present disclosure, any components which can tilt the air discharger 500 in a specific direction may be applied.

Multiple vanes 560 and 560' (e.g., a plurality of vanes 560, and a plurality of vanes 560') may be installed respectively between the first outlet 422 of the duct 400 and a first side discharge hole of the air discharger 500 and between the second outlet 424 of the duct 400 and a second side discharge hole of the air discharger 500.

A vane rotation center member 558 may be mounted to each of the first outlet 422 and the second outlet 424 of the second duct 420. Multiple vanes 560 or 560' may be mounted to each vane rotation center member 558 such that the multiple vanes can rotate at predetermined angles. That is, the vane rotation center member 558 controls the rotation of the plurality of vanes 560, 560' of the respective side of the air discharger 500.

Each of the vanes 560 or 560' (i.e., plurality of vanes may preset the direction of air to be discharged through the discharge holes of the air discharger 500. The vane 560 or 560' may include multiple vanes disposed at predetermined intervals.

Figure 8A:
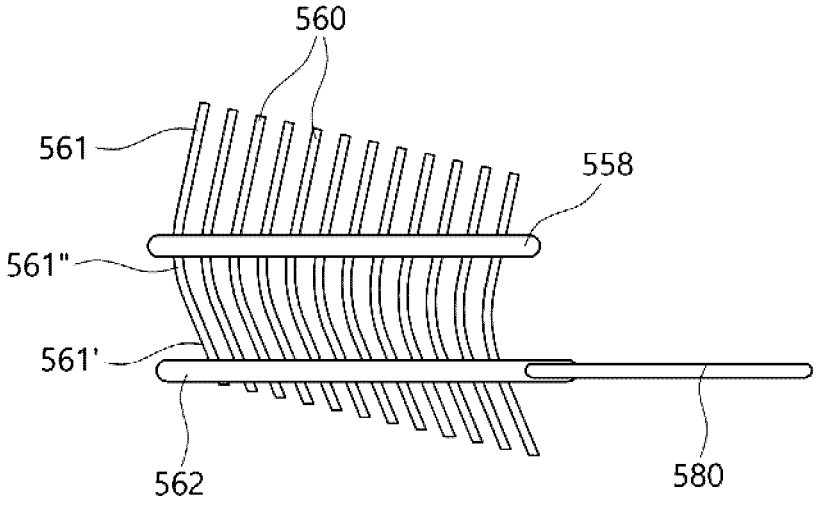
FIGS. 8A and 8B are side views illustrating the configuration of an important part of each of the vanes illustrated in FIG. 7.
Figure 8B:
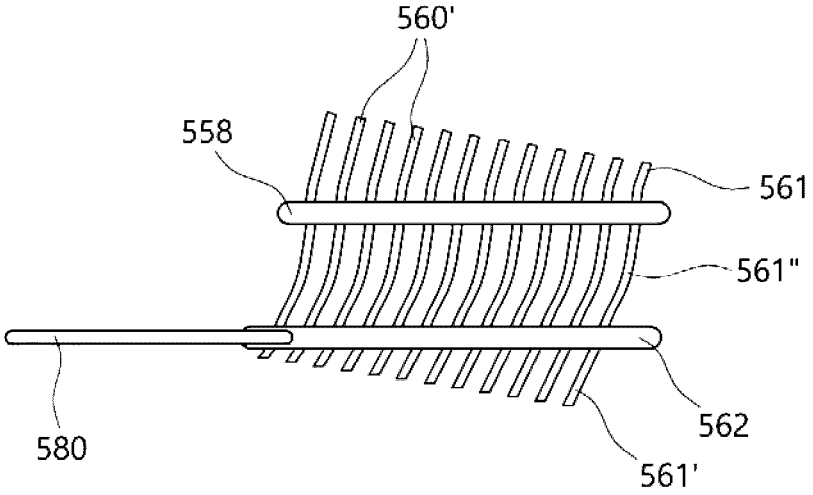

The vane 560 or 560' may function to preset the direction of air to be discharged through the discharge holes. As illustrated in FIGS. 8A and 8B, in the vane 560 or 560', an upper flow part 561 and a lower flow part 561' which are plates, respectively, having predetermined shapes may be connected to each other such that the upper flow part 561 and the lower flow part 561' have a predetermined angle therebetween. The upper flow part 561 and the lower flow part 561' may be connected to each other by a connection curved part 561" having a predetermined radius of curvature.

At least a portion of the upper flow part of the vane 560 or 560' may be located inside the second duct 420. The lower flow part of the vane 560 or 560' may be mainly located inside the air discharger 500.

The vane 560 or 560' may have more portions located in the second duct 420 gradually in an air flow direction in the second duct 420. That is, the vane 560 or 560' may be located at the position of height increasing gradually in the air flow direction in the second duct 420. Additionally, the vane 560 located in the second outlet 424 may be located at a position higher than the vane 560' located in the first outlet 422.

Such configuration can be seen even in FIG. 3. This is intended to allow air flowing in the second duct 420 to evenly flow through the entire portion of each of the first outlet 422 and the second outlet 424.

As for the length of the vane 560 or 560', the vane 560' located at the first outlet 422 may be longer than the vane 560 located at the second outlet 424. This is intended to allow air to flow through the discharge holes without air being wasted gradually toward the end of the second duct 420.

The vane 560 or 560' may guide air to the lower portion of the air discharger 500. According to the rotated state of the vane 560 or 560' relative to the vane rotation center member 558, a direction in which the vane guides air may be changed.

A vane drive member 562 may be provided to control the operation state of each of the vane 560 and 560'. Like the vane rotation center member 558, the vane drive member 562 maybe connected to each of the vanes 560 and 560'.

The vane drive member 562 may be connected relatively rotatably to the vane 560 or 560' at a position located apart from a portion at which the vane rotation center member 558 is connected to the vane 560 or 560' and toward the discharge holes. One vane drive member 562 may be used for each of the opposite sides of the vane 560 or 560'. That is, one vane drive member 562 may be used for both of the vanes 560, 560'. Alternatively, only one vane drive member 562 may be used for the vane 560 or 560'. That is, each vane 560 or 560' may have its own vane drive member 562.

Vane motors 570 may be provided to drive the vanes 560 and 560', respectively. A drive link 574 may be connected to each of the vane motors 570. The drive link 574 may be driven by the operation of the vane motor 570. Further, each drive link 574 may be connected to the vane motor 570 via a drive part 580. That is, each drive part 580 may extend between a respective drive link 574 and the respective vane drive member 562.

The vane drive member 562 may be connected to the drive link 574 and may be driven according to the operation of the drive link 574.

Meanwhile, the hygiene management device 1000 may include a first detector 354 and a second detector 356. A first detector 354 may detect the opening/closing of the entrance door 14, and the second detector 356 may detect whether a user is present at a preset position in the space 12 of the entrance hall 10. The second detector 356 may preferably detect whether the user is present on the footrest 100.

The first detector 354 may be mounted to the entrance door 14, and for example, may be embodied as a reed switch or a push-pull switch.

The second detector 356 may be mounted to the front surface part of the function module 350. However, the installation location of the second detector 356 may be any location in which a user on the footrest 100 can be detected. For example, the second detector 356 may be embodied as an infrared sensor, an ultrasonic sensor, or a laser distance sensor.

Alternatively, the second detector 356 may be mounted to the footrest 100 and may detect whether a user stands on the footrest 100. Accordingly, the second detector 356 may be embodied as a weight sensor or a piezoelectric sensor.

The first and second detectors 354 and 356 may transmit results respectively detected thereby to the controller 900, which is described below.

Figure 10:
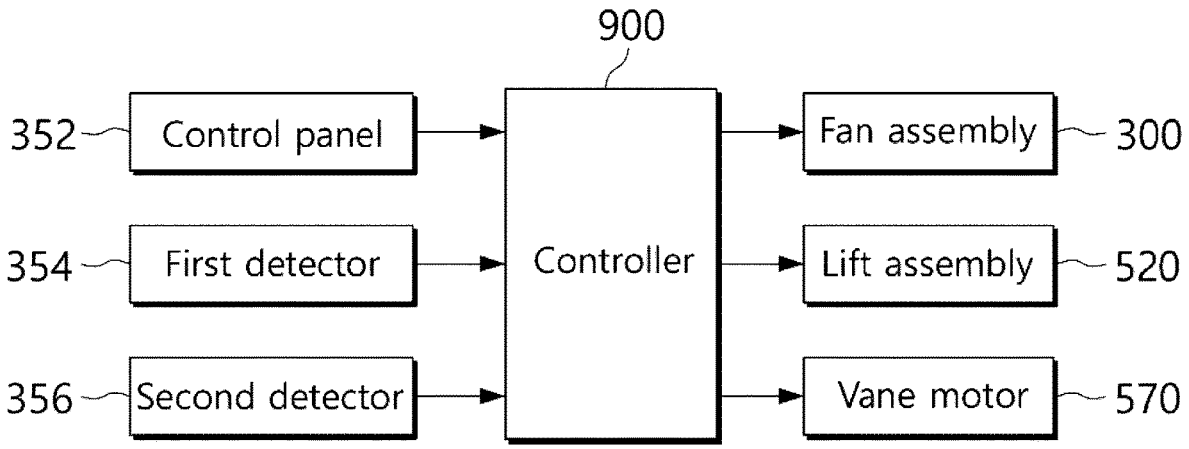
FIG. 10 is a block diagram of components connected to a controller according to an embodiment of the present invention.

FIG. 10 is a block diagram of components connected to the controller which controls the hygiene management device of the present disclosure, and FIGS. 11 to 14 are the flowcharts illustrating the control method of the hygiene management device according to the embodiments of the present disclosure.

Figure 11:
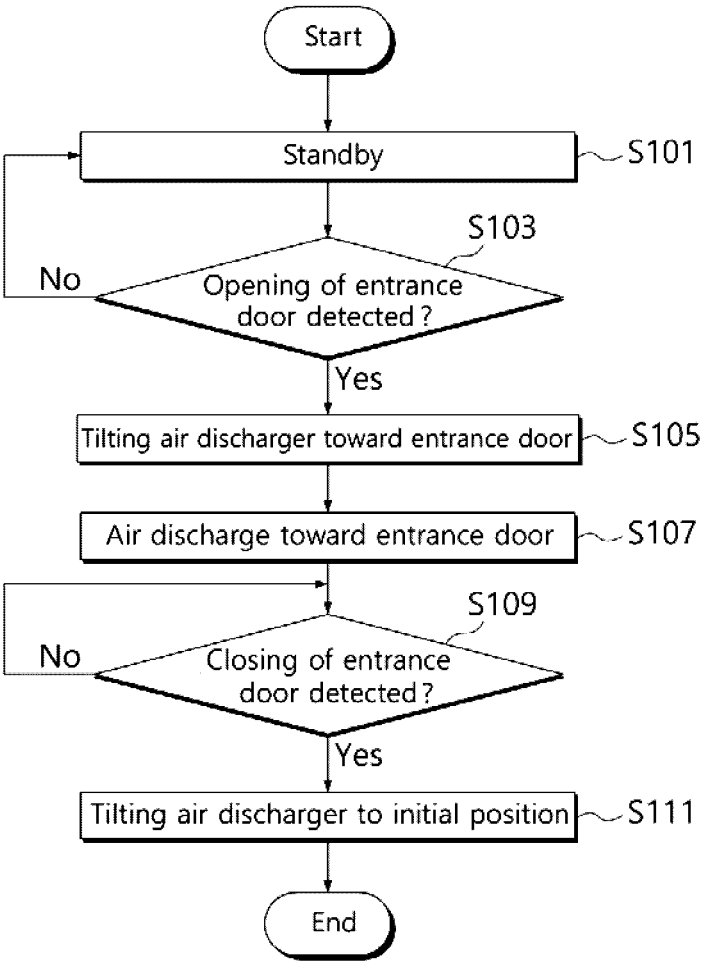
FIGS. 11 to 14 are flowcharts illustrating the control method of a hygiene management device for an entrance hall according to embodiments of the present invention.

Referring to FIGS. 10 and 11, the operation of the hygiene management device 1000 according to the opening and closing of the entrance door 14 will be described.

In a state in which the hygiene management device 1000 of the present disclosure is installed in the space 12 of the entrance hall 10, as shown in FIG. 11, the hygiene management device 1000 may initially maintain a standby state at S101. In the standby state, the air discharger 500 may be preset in a preset initial direction, and preferably, may be preset to be directed toward the center of the space 12 of the entrance hall 10. Additionally, in the standby state, the air discharger 500 does not discharge air.

In the standby state, when the entrance door 14 is opened, the first detector 354 may detect the opening of the entrance door 14 at S103. The detected result may be transmitted to the controller 900.

Accordingly, the controller 900 may drive the lift assembly 520 and may tilt the air discharger 500 such that the lower surface part of the air discharger 500 is directed toward the entrance door 14 at S105. That is, the direction of air discharged by the air discharger 500 may be directed toward the entrance door 14.

In addition, the controller 900 may drive the fan assembly 300 such that air is discharged by the air discharger 500 at S107.

This is intended for the air discharger 500 to discharge air toward the entrance door 14 such that external air is prevented from being introduced into the entrance space 12 through the opened entrance door 14. In this case, in the state in which the air discharger 500 is tilted, the fan assembly 300 may be driven to discharge air with a relatively higher wind pressure.

FIG. 9B illustrates an example in which the lower surface of the air discharger 500 is directed slantingly toward the entrance door 14 by tilting the air discharger 500 toward the entrance door 14.

FIG. 9A illustrates that the lower surface of the air discharger 500 is directed downward, and FIG. 9B illustrates that the lower surface of the air discharger 500 is directed rightward. For example, in FIG. 9B, the height of the air discharger 500 at a side at which the first lift 521 is located is decreased, and the height of the air discharger 500 at a side at which the second lift 521' is located is relatively increased.

Accordingly, the air discharger 500 may discharge air slantingly toward the entrance door 14. When the air discharger 500 operates in the opposite direction, the air discharger 500 may be restored to a present initial position from the tilted state of the air discharger 500.

Here, the tilting of the air discharger 500 at S105 and the discharging of air at S107 may be performed simultaneously or within a preset time difference. Alternatively, in another embodiment, the discharging of air may be performed before the tilting.

Later, when the entrance door 14 is closed, the first detector 354 may detect the closing of the entrance door 14 at S109. The detected result may be transmitted to the controller 900.

Accordingly, the controller 900 may drive the lift assembly 520 such that the air discharger 500 tilted toward the entrance door 14 is restored to an initial position at S111. At the initial position, the direction of air discharged by the air discharger 500 may be directed toward the center of the space 12 of the entrance hall 10.

When the air discharger 500 is tilted to the initial position, whether to stop the air discharge may be determined according to whether there is a user in the space 12 of the entrance hall 10.

Figure 12:
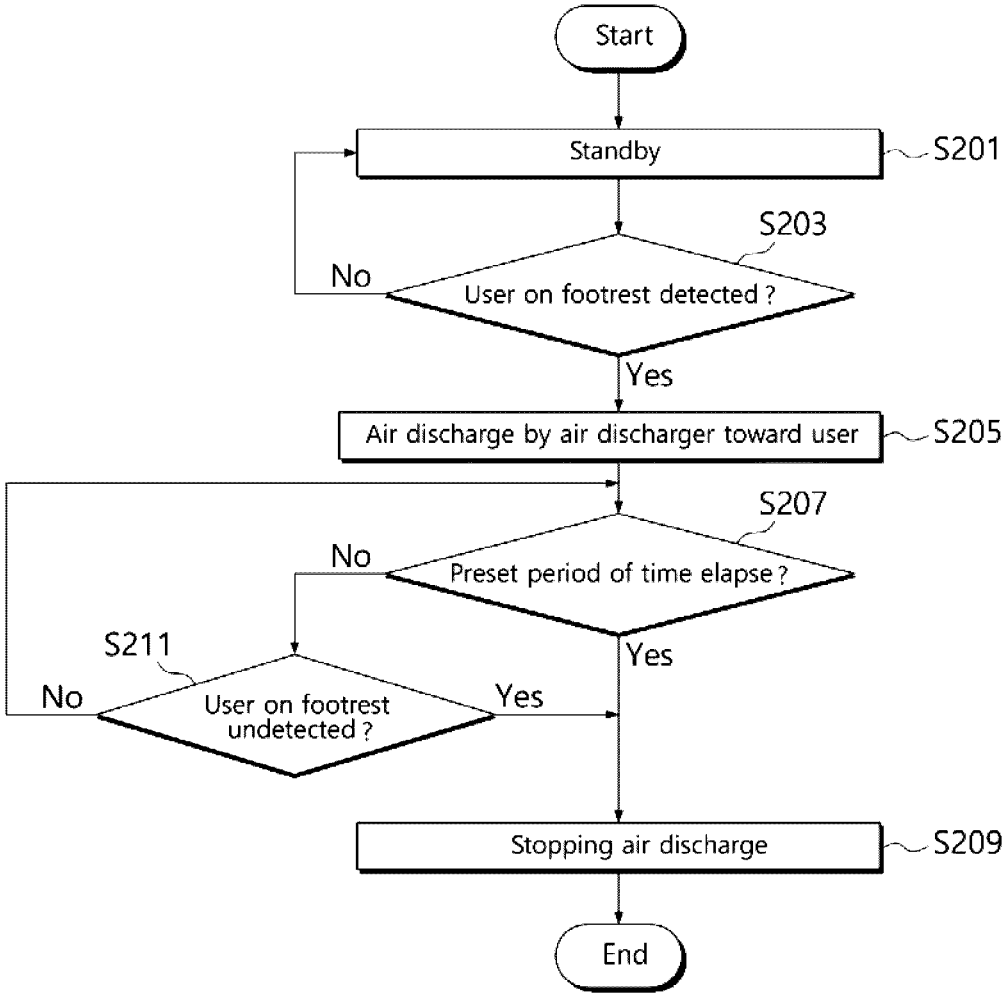

Referring to FIGS. 10 and 12, the operation of the hygiene management device 1000 of the present disclosure when a user stands on the footrest 100 is described.

The hygiene management device 1000 may maintain a standby state at S201, and when a user stands on the footrest 100, the second detector 356 may detect the user on the footrest 100 at S203. The detected result may be transmitted to the controller 900.

Accordingly, the controller 900 may drive the fan assembly 300 such that the air discharger 500 discharges air toward the user at S205. This is intended to remove contaminants attached to the user's body and clothes by the air discharge.

The air discharge may be performed for a preset period of time, and when the preset period of time elapses at S207, the controller 900 may stop the fan assembly 300 and the air discharge may stop at S209.

However, before the preset period of time elapses, when the user descends from the footrest 100 (i.e., the user steps off the footrest 100), the second detector 356 may detect this at S211, and the controller 900 may stop the fan assembly 300 such that the air discharge stops at S209.

As described above, when the fan 316 operates due to the operation of the fan assembly 300, an air flow may be generated. Hereinafter, the introduction and discharging of air according to the air flow will be described.

Figure 15:
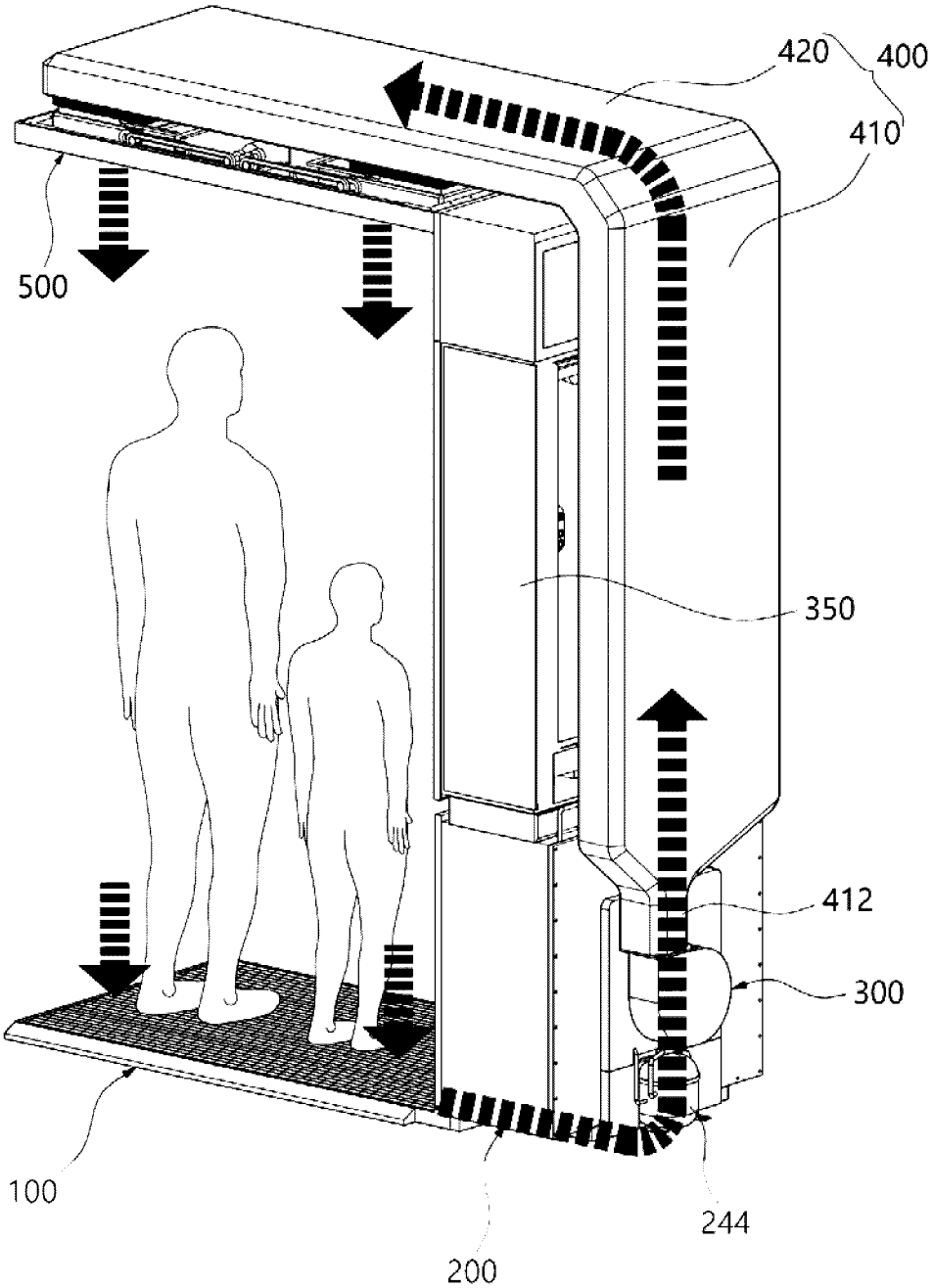
FIG. 15 is a view illustrating that the discharge and introduction of air are performed when a user is located on a footrest according to an embodiment of the present invention.

When the fan assembly 300 is operated by the controller 900, the fan 316 may rotate. Due to the rotation of the fan 316, air may be introduced into the footrest 100 through the multiple introduction holes formed in the footrest 100. In FIG. 15, an air flow for air introduction and discharge is illustrated properly.

The introduced air may be introduced through the first, second, and third filters 221, 223, and 225 of the air management module 200 into the fan assembly 300. The air introduced into the fan assembly 300 may flow due to the rotation of the fan 316, and may be introduced into the duct 400.

The air transferred to the first duct 410 of the duct 400 may flow to the second duct 420 and may be transferred sequentially to the first outlet 422 and the second outlet 424 of the second duct 420. The vanes 560 and 560' may be located at the first outlet 422 and the second outlet 424, respectively, and thus the flowing air may be introduced into to the first outlet 422 and the second outlet 424 by being guided by the vanes 560 and 560', respectively.

In addition, the multiple vanes may be disposed at each of the first outlet 422 and the second outlet 424 such that the vanes have a predetermined height difference therebetween and are spaced apart at predetermined intervals from each other, so air may be spread relatively evenly in the first outlet 422 and the second outlet 424 to flow.

For the operation of the vane 560, the drive link 574 may be reciprocated rectilinearly by the vane motor 570. Due to the rectilinear reciprocation of the drive link 574, the vane drive member 562 may move and thus the vane 560 may rotate at a predetermined angle relative to the vane rotation center member 558 (e.g., via the drive part 580). Due to such rotation of the vane 560, air discharge direction may be changed.

Figure 18A:
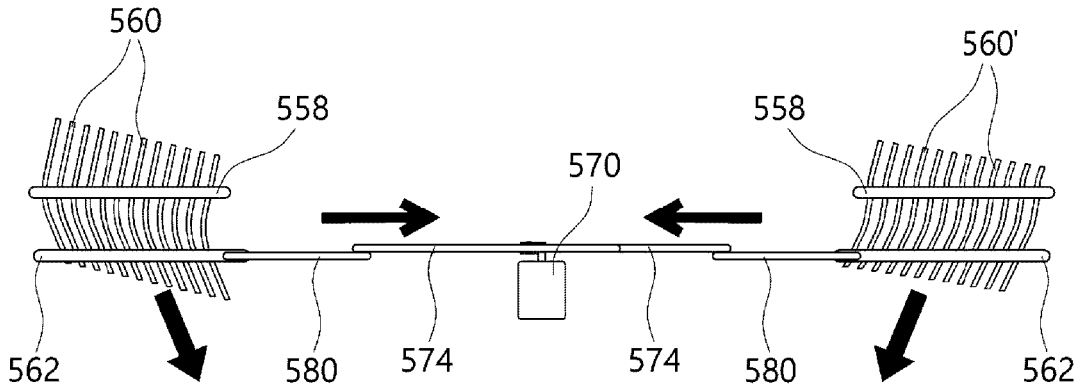
FIG. 18A is a view illustrating a state in which air can be discharged toward the center of the lower portion of the entrance space.

In FIG. 18A, a state in which the drive link 574 is pulled toward the vane motor 570 is illustrated. In this state, air may be guided along the vane 560 and may be discharged toward the center of the lower side of the air discharger 500. This is applied to the discharge hole corresponding to the first outlet 422 and the discharge hole corresponding to the second outlet 424.

Figure 18B:
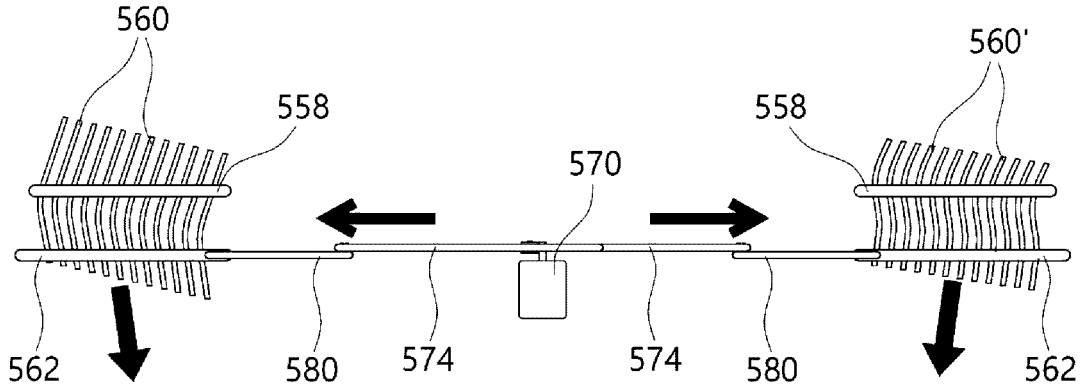
FIG. 18B is a view illustrating a state in which air can be discharged toward the lower portion of the entrance space.

In FIG. 18B, a state in which the drive link 574 is moved in a direction away from the vane motor 570 is illustrated. In this case, air may be discharged to the lower side of the air discharger 500.

Figure 13:
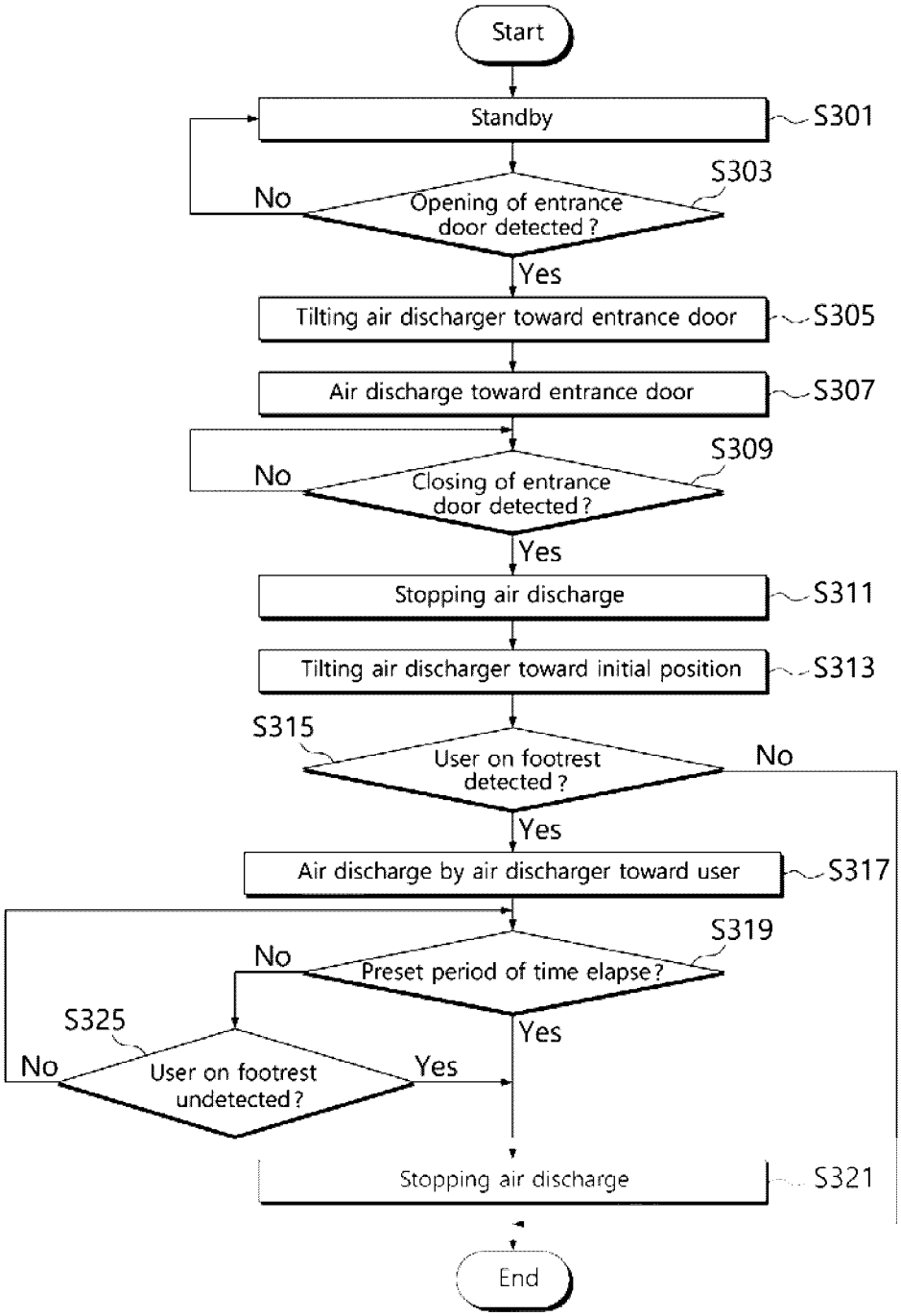

Referring to FIGS. 10 and 13, when a user goes into the entrance space 12 through the entrance door 14 and stands on the footrest 100, the operation of the hygiene management device 1000 of the present disclosure is described.

When the entrance door 14 is opened such that a user goes into the entrance space 12 from the outside while the hygiene management device 1000 maintains a standby state at S301, the first detector 354 may detect the opening of the entrance door 14 at S303. The detected result may be transmitted to the controller 900.

Accordingly, the controller 900 may drive the lift assembly 520 and may tilt the air discharger 500 such that the lower surface of the air discharger 500 is directed toward the entrance door 14 at S305. Additionally, the controller 900 may enable the air discharger 500 tilted by driving the fan assembly 300 to discharge air toward the entrance door at S307.

Figure 16:
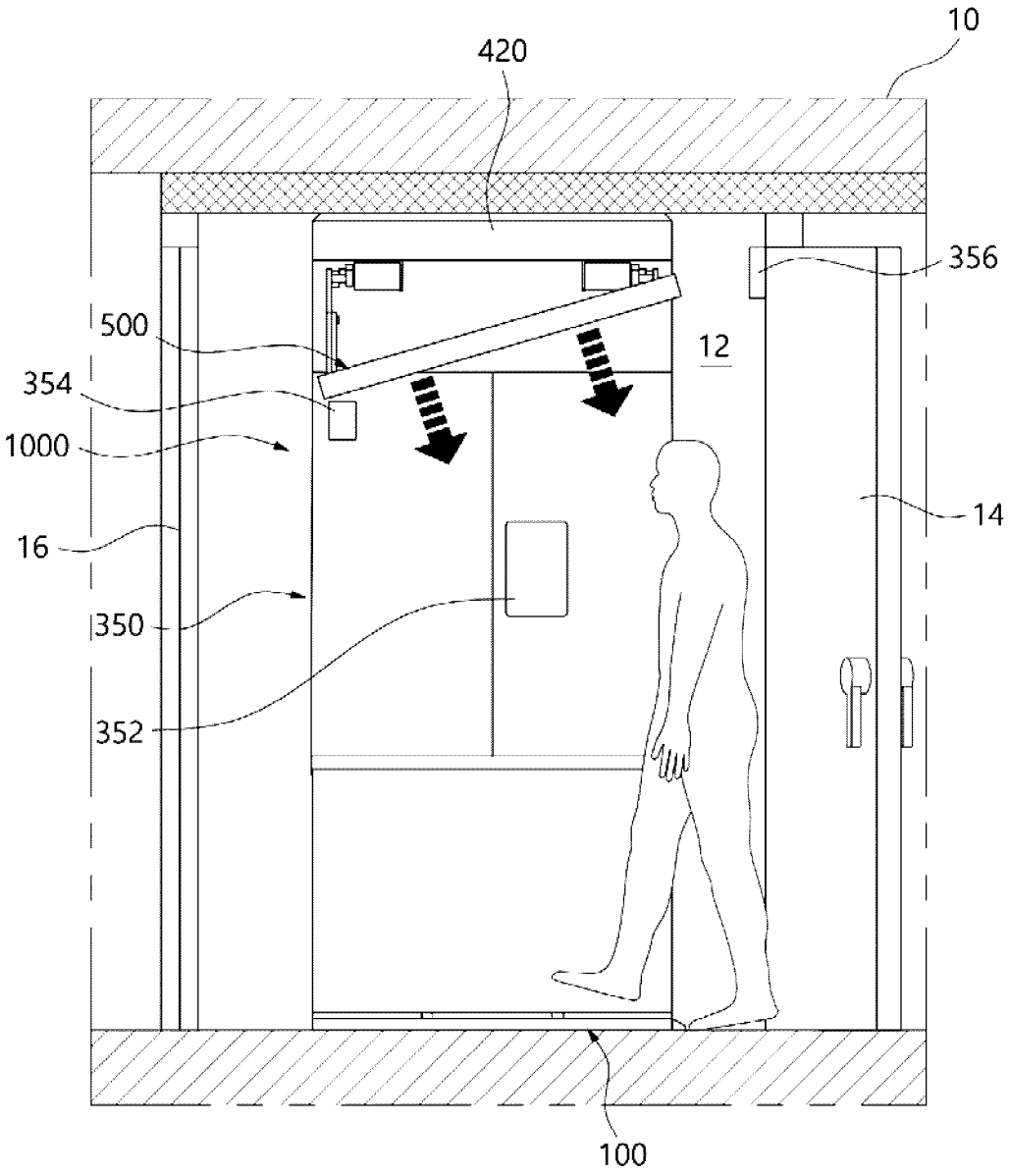
FIG. 16 is a view illustrating a state in which the air discharger is tilted toward the entrance door when a user comes into the entrance space through an entrance door according to an embodiment of the present invention.

FIG. 16 illustrates the performance of the tilting and air discharging of the air discharger 500 when a user comes into the entrance space through the entrance door 14. In the process in which the user comes into the entrance space through the entrance door 14, external air may be prevented from being introduced into the entrance space 12 through the opened entrance door 14 by discharging air through the air discharger 500 toward the entrance door 14.

Next, when the entrance door 14 is closed after the user comes into the space 12 of the entrance hall 10, the first detector 354 may detect the closing of the entrance door 14 at S309. The detected result may be transmitted to the controller 900.

Accordingly, the controller 900 may stop the fan assembly 300 such that air discharge stops at S311. Additionally, the controller 900 may drive the lift assembly 520 such that the air discharger 500 tilted toward the entrance door 14 is restored to an initial position at S313.

Later, when a user is located on the footrest 100, the second detector 356 may detect this at S315. The result detected by the second detector 356 may be transmitted to the controller 900 (e.g., as shown in FIG. 9A).

Accordingly, the controller 900 may drive the fan assembly 300 such that the air discharger 500 discharges air toward a user at S317. In this case, due to the operation of the fan assembly 300, the footrest 100 may introduce air in the entrance space 12 thereto through the multiple introduction holes.

The air discharge may be performed for a preset period of time, and when the preset period of time elapses at S319, the controller 900 may stop the fan assembly 300 and stop the air discharge at S321.

However, before the preset period of time elapses, when the user descends from the footrest 100 (i.e., the user steps off of the footrest 100), the second detector 356 may detect this at S323, and the controller 900 may stop the operation of the fan assembly 300 to stop air discharge at S321.

Figure 14:
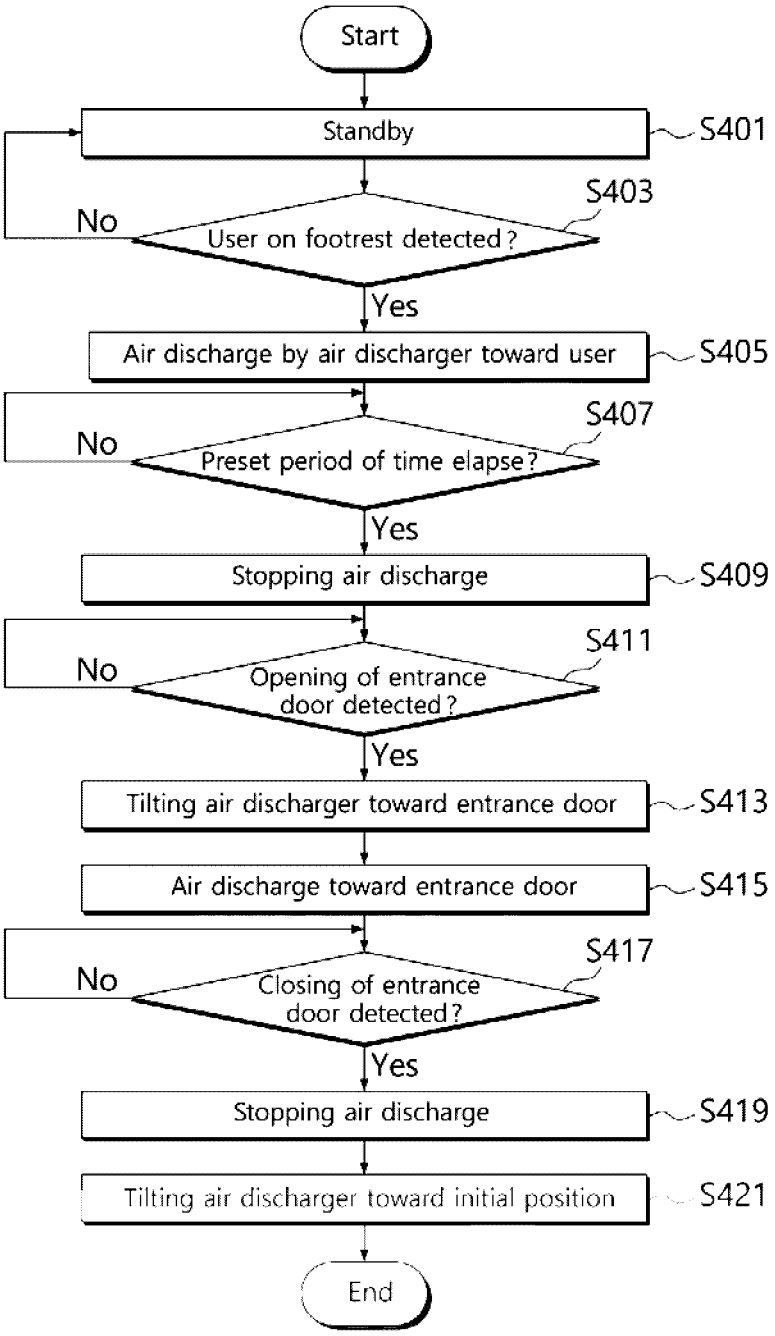

Referring to FIGS. 10 and 14, the operation of the hygiene management device 1000 of the present disclosure when a user goes out to the outside through the entrance door 14 is described.

In a state in which the hygiene management device 1000 is in a standby state at S401, when a user coming out through the inside door 16 stands on the footrest 100, the second detector 356 may detect the user on the footrest 100 at S403 and may transmit the detected result to the controller 900.

Accordingly, the controller 900 may drive the fan assembly 300 such that the air discharger 500 discharges air toward the user at S405.

The air discharge may be performed for a preset period of time, and when the preset period of time elapses at S407, the controller 900 may stop the fan assembly 300 and may stop the air discharge at S409.

When the entrance door 14 is opened such that the user goes out to the outside from the entrance space, the first detector 354 may detect the opening of the entrance door 14 at S411 and may transmit the detected result to the controller 900.

Accordingly, the controller 900 may drive the lift assembly 520 and tilt the air discharger 500 toward the entrance door 14 at S413. Additionally, the controller 900 may drive the fan assembly 300 such that the air discharger 500 discharges air toward the entrance door 14 at S415.

The tilting of the air discharger 500 at S413 and the discharging of air at S415 may be performed simultaneously or within a preset time difference.

Figure 17:
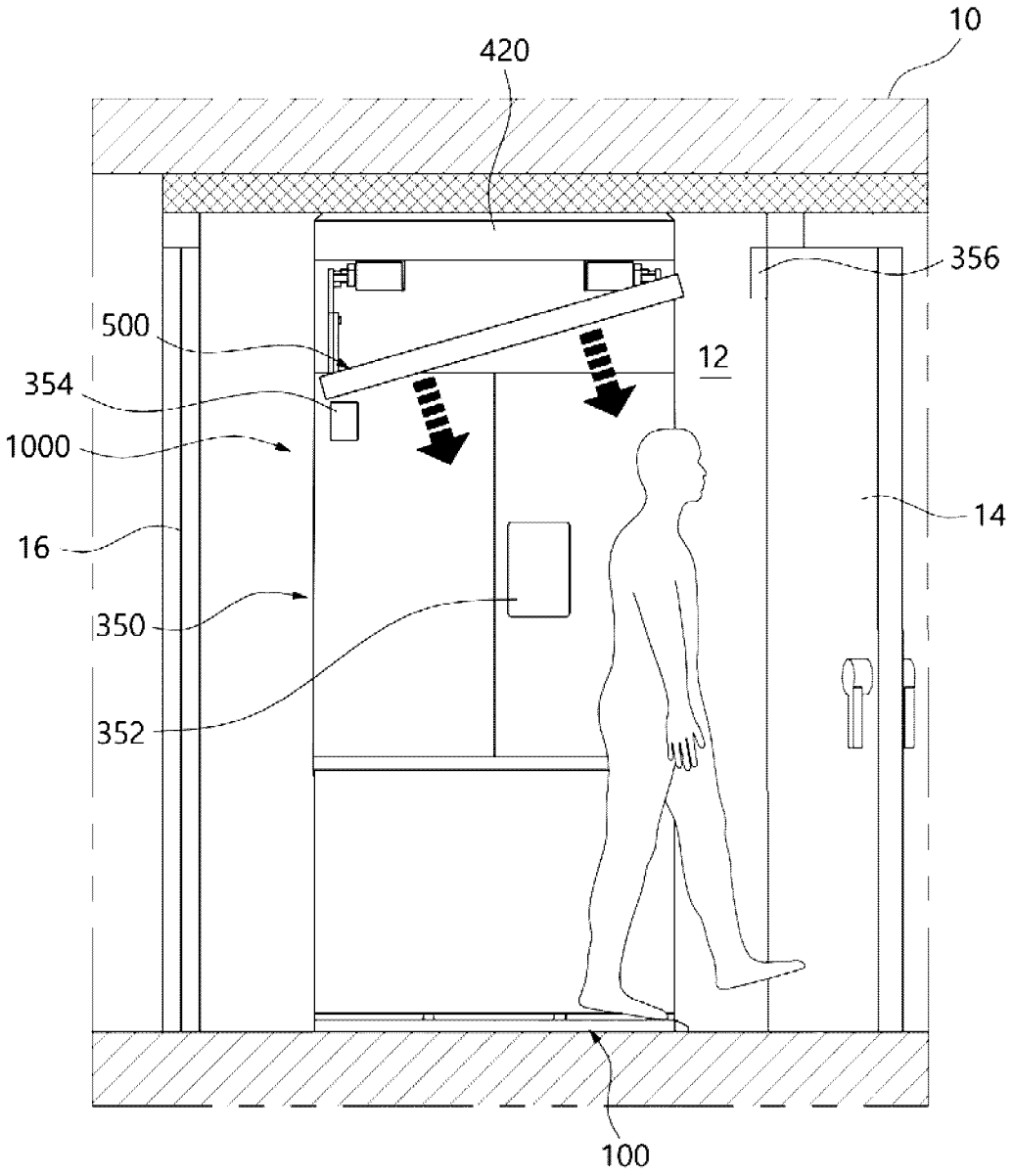
FIG. 17 is a view illustrating a state in which the air discharger is tilted toward the entrance door when a user goes out of the entrance space through the entrance door according to an embodiment of the present invention.

FIG. 17 illustrates an example in which the tilting (e.g., toward the entrance door 14) and air discharge of the air discharger 500 are performed when a user goes out to the outside through the entrance door 14. In the process in which the user goes out to the outside through the entrance door 14, external air may be prevented from being introduced into the entrance space 12 through the opened entrance door 14 by discharging air toward the entrance door 14.

Later, when the entrance door 14 is closed after the user goes out to the outside, the first detector 354 may detect the closing of the entrance door 14 at S417. The detected result may be transmitted to the controller 900.

Accordingly, the controller 900 may stop the operation of the fan assembly 300 such that the air discharger 500 stops the air discharge at S419. Additionally, the controller 900 may drive the lift assembly 520 such that the air discharger 500 tilted toward the entrance door 14 is tilted to an initial position to be restored thereto at S421, as shown in FIG. 9A.

Various embodiments described herein may be implemented in a computer-readable medium using, for example, software, hardware, or some combination thereof. For example, the embodiments described herein may be implemented within one or more of Application Specific Integrated Circuits (ASICs), Digital Signal Processors (DSPs), Digital Signal Processing Devices (DSPDs), Programmable Logic Devices (PLDs), Field Programmable Gate Arrays (FPGAs), processors, controllers, micro-controllers, microprocessors, other electronic units designed to perform the functions described herein, or a selective combination thereof. In some cases, such embodiments are implemented by the controller. That is, the controller is a hardware-embedded processor executing the appropriate algorithms (e.g., flowcharts) for performing the described functions and thus has sufficient structure. Also, the embodiments such as procedures and functions may be implemented together with separate software modules each of which performs at least one of functions and operations. The software codes can be implemented with a software application written in any suitable programming language. Also, the software codes can be stored in the memory and executed by the controller, thus making the controller a type of special purpose controller specifically configured to carry out the described functions and algorithms. Thus, the components shown in the drawings have sufficient structure to implement the appropriate algorithms for performing the described functions.

In the above, although all components constituting the hygiene management device according to the embodiment of the present disclosure are described as being integrally combined or being operated in combination, the present disclosure is not necessarily limited to this embodiment. That is, within the scope of the present disclosure, at least two of all the components may operate by being selectively combined with each other. In addition, terms such as "include", "comprise", or "have" described above mean that the associated components may be inherent unless otherwise stated, so the terms should be construed not to exclude other components but to further include the other components.

What is claimed is:

1. A hygiene management device for an entrance hall, the device comprising:

a first detector configured to detect an opening/closing of an entrance door located in the entrance hall;

an air discharger located in the entrance hall and configured to discharge air in a downward direction toward a space;

a fan assembly configured to generate a flow of air toward the air discharger to allow the air discharger to discharge air to the space;

a duct connecting the fan assembly with the air discharger;

a lift assembly configured to tilt the air discharger;

a plurality of vanes configured to control a direction of air discharged through the air discharger; and a controller configured to drive the fan assembly and the lift assembly, in response to the first detector detecting the opening of the entrance door, the controller being configured to:

drive the lift assembly such that the air discharger is tilted, and drive the fan assembly such that the tilted air discharger discharges air, wherein upper portions of the plurality of vanes are disposed in the duct and lower portions of the plurality of vanes are disposed in the air discharger, wherein the lift assembly includes:

a first lift mounted at a first side of the air discharger;

a second lift mounted at a second side of the air discharger opposite to the first side of the air discharger; and at least one lift motor configured to drive the first lift and the second lift, and wherein the first lift is configured to operate to tilt the air discharger such that the first side of the air discharger is lowered and the air discharger is angled toward the entrance door.

2. The hygiene management device of claim 1, wherein the plurality of vanes includes a first plurality of vanes and a second plurality of vanes wherein the second plurality of vanes are located downstream in the duct with respect to the first plurality of vanes, and wherein a length of at least one upper portion of the plurality of second vanes is larger than a length of at least one upper portion of the first plurality of vanes.

3. The hygiene management device of claim 1, wherein the controller is configured to stop an operation of the fan assembly such that the discharging of air stops in response to a preset period of time elapsing after the discharging of air.

4. The hygiene management device of claim 3, further comprising:

a footrest positioned at a bottom of the space of the entrance hall; and a second detector configured to detect whether a user is present on the footrest, wherein the controller is configured to stop the operation of the fan assembly such that the discharging of air stops in response to the user not being detected on the footrest by the second detector before the preset period of time elapses.

5. The hygiene management device of claim 4, wherein the footrest includes a plurality of introduction holes, and wherein the plurality of introduction holes are configured to receive air discharged from the air discharger.

6. The hygiene management device of claim 1, wherein the controller is configured to, while the air discharger is tilted, in response to the closing of the entrance door being detected by the first detector, drive the lift assembly to tilt the tilted air discharger to an initial position, and wherein in the initial position, the air discharger faces a center of the space of the entrance hall.

7. The hygiene management device of claim 1, further comprising:

a footrest positioned at a bottom of the space of the entrance hall; and a second detector configured to detect whether a user is present on the footrest, wherein the controller is configured to drive the fan assembly such that the air discharger discharges air toward the user in response to the second detector detecting the user is on the footrest.

8. The hygiene management device of claim 2, wherein the first plurality of vanes includes a first vane disposed at the first side of the air discharger; and wherein the second plurality of vanes includes a second vane disposed at the second side of the air discharger spaced from the first vane, and wherein the first vane and the second vane are configured to receive air from the fan assembly and to discharge air in a preset direction.

9. The hygiene management device of claim 8, wherein the first vane is disposed closer to the fan assembly than the second vane, and wherein the second vane is disposed higher with respect to a vertical direction than the first vane.

10. The hygiene management device of claim 8, wherein the first vane has a longer length than the second vane.

11. The hygiene management device of claim 1 wherein the duct comprises:

a first duct disposed in a vertical direction, and a second duct that connects to the first duct and is disposed in a horizontal direction, wherein the first duct is disposed closer to the fan assembly than the second duct, and wherein the second duct is disposed closer to the air discharger than the first duct.

12. The hygiene management device of claim 11, wherein the upper portions of the plurality of vanes are disposed in the second duct.

13. The hygiene management device of claim 11, wherein the first lift and second lift are located under the second duct with respect to the vertical direction.

14. The hygiene management device of claim 1, wherein each of the first lift and the second lift is configured to move in a vertical direction.

15. The hygiene management device of claim 1, wherein the at least one lift motor comprises:

a first lift motor configured to drive the first lift; and a second lift motor configured to drive the second lift.

16. The hygiene management device of claim 15, wherein the first lift motor and the second lift motor are each located on a bottom surface of the duct.

* * * * *